United States Patent [19]

Horn et al.

[11] Patent Number: 4,646,047

[45] Date of Patent: Feb. 24, 1987

[54] ELECTRICAL COIL FORM WITH CONNECTOR PINS

[75] Inventors: Guenther Horn; Wolfgang Pieper, both of Wuerzburg; Heribert Roeser, Mainbernheim, all of Fed. Rep. of Germany

[73] Assignee: Siemens Aktiengesellschaft, Munich and Berlin, Fed. Rep. of Germany

[21] Appl. No.: 781,072

[22] Filed: Sep. 27, 1985

[30] Foreign Application Priority Data

Sep. 29, 1984 [DE] Fed. Rep. of Germany ..... 3435887

[51] Int. Cl.[4] ..... H01F 15/10; H01F 27/30

[52] U.S. Cl. ..... 336/192; 29/602 R; 336/208; 339/220 R

[58] Field of Search ..... 339/220 R, 220 C, 221 M, 339/217 R, 218 R, 218 C, 218 M, 217 J; 336/192, 198, 208; 310/71; 29/602 R

[56] References Cited

U.S. PATENT DOCUMENTS

| | | | |
|---|---|---|---|
| 1,771,635 | 7/1930 | Hubbell, Jr. | 339/218 R |
| 2,057,718 | 10/1936 | Gunthorp | 339/221 R |
| 2,099,555 | 11/1937 | Benander | 339/221 R X |
| 2,483,801 | 10/1949 | Becwar | 336/192 X |
| 3,453,575 | 7/1969 | Davis | 336/198 X |
| 3,457,534 | 7/1969 | Davis | 336/192 |

FOREIGN PATENT DOCUMENTS

| | | | |
|---|---|---|---|
| 2758700 | 2/1980 | Fed. Rep. of Germany . | |
| 1280703 | 11/1961 | France | 339/220 |
| 1519754 | 2/1968 | France | 339/220 |
| 629813 | 9/1949 | United Kingdom | 339/220 R |
| 863628 | 3/1961 | United Kingdom | 339/220 |
| 1087741 | 10/1967 | United Kingdom . | |

*Primary Examiner*—Thomas J. Kozma

*Attorney, Agent, or Firm*—F. W. Powers; J. L. James

[57] ABSTRACT

The invention has developed an improved coil form permitting automated fabrication of a strain-relieved connection between external leads fed in an insulated fashion through an opening of a surrounding motor stator housing and the winding ends of the exciter winding wound on the coil form; for that purpose the design has a plastic bracket hinge-mounted and molded on an end flange of the coil form, which upon making the connection can be pivoted over the exciter winding and can then mate with the other end flange. Said plastic bracket has flat-tongued connector pins in access openings each having terminals on the inside for connection to the winding ends, which penetrate until they catch against a spacer piece overhanging the access opening and coming up against the outer side of the plastic bracket to ensure strain-relieved fastening; for additional anchoring, the projecting, still unwound internal terminals are twisted at a certain circumferential angle in an axially concentric fashion facing their portion inserted in the plastic bracket immediately above the access opening.

This invention is particularly suitable for small synchronous motors fabricated on automated production lines.

7 Claims, 5 Drawing Figures

ELECTRICAL COIL FORM WITH CONNECTOR PINS

BACKGROUND OF THE INVENTION

This invention relates to an electrical coil form and more particularly to one having a cylindrical space of windings opening radially to the outside and bounded axially by end flanges, with a molded-on plastic bracket hinge-mounted to one of the end flanges, which can be pivoted over the winding space. The plastic bracket has single-component connector pins therein with external terminals projecting radially outward for connecting to external connector lines and radially inward-projecting terminals for connecting to the coil winding ends.

One electrical coil form of this type is known from Federal Republic of Germany Patent No. 2,785,700. During the injection-molded manufacture of this known coil form, a hinge-like plastic bracket is integrally formed on one of the flanges of the coil form body. This known manufacturing process requires tongue-shaped connector terminals first to be inserted into the mold and then molded as part of the process forming the rest of the coil. Thus, by the molding process these pins are mechanically secured to the coil form, providing a strain relieved intermediate connection point for connecting the coil ends to the external leads. The plastic bracket is pivoted into the operating position over the winding space along the hinge-like axis attached to one end flange and is interlocked with the other end flange. The winding ends of the coil would upon the coil body are connected to the radially inward penetrating internal portion of the injection molded tongue-shaped connector terminals, and the external portion of the injection molded tongue-shaped connector terminals are radially outward penetrating in the operating position of the plastic bracket, and provide connector pins onto which an external cable can be plugged.

It is the object of this invention to develop a simplified manufacturing procedure of an electrical coil form ensuring strain-relieved contacting between the winding ends of the coil wound on the coil form, on the one hand, and the conductor end of the external connecting leads on the other hand, particularly from the perspective of developing an automated fabrication and assembly procedure.

SUMMARY OF THE INVENTION

Briefly stated in accordance with one aspect of the invention, the foregoing object is achieved by providing a coil form having a U-shaped cross section winding space which is radially open to the outside and bounded axially by end flanges connected to the coil form; an integrally molded plastic bracket hinge-mounted to one of the end flanges, which can be pivoted over the winding space; and single-component connector pins with external connector pins projecting radially outward from the plastic bracket for the connection of external leads, and internal terminals projecting radially inward for the connection of the coil winding ends. The plastic bracket can initially be pivoted away from the winding space to facilitate connection of the coil winding ends to the internal terminals. Subsequently, the bracket can be pivoted in the opposite direction into a locking engagement with the other end flange, while still having the coil winding ends attached. The invention being further characterized by having the plastic bracket provided with radially penetrating access openings into which the single component connector pins are inserted, each having an internal terminal penetrate from the outer surface of the plastic bracket until a transversely aligned spacer portion which overhangs each respective access opening against the bracket outer surface to provide a strain relieved positioning.

In accordance with the invention, it is possible in a simple manufacturing process to fabricate the coil form with its integrally molded hinge-like plastic bracket as a simple injection-molded universal component without connecting pins which have to be arranged in the mold and molded simultaneously; subsequently, in a simple automated assembly process the connecting pins with their internal terminals can then be inserted up to the strain-relieved catch of the transversely oriented spacer portion of each pin. Then while mechanically inserting the winding on the coil form, the internal terminals are wrapped by the winding ends and, if necessary, additionally connected by dip soldering. Then, after folding back the plastic bracket over the windings wound onto the coil body, interlocking the bracket with the facing end flange of the coil form, the plastic bracket forms an insulated conduit for the external terminals when the coil is inserted in a surrounding housing, for example of a pulse motor housing, and the external leads for the coil are plug-connected to the external pins of the plastic bracket by means of an attached connector.

For additional strain relieving fastening of the connector pins following their insertion in the plastic brackets, one embodiment twists the internal, still-unwound terminals projecting out of the plastic bracket in an axially concentric fashion facing the portion inserted into the plastic bracket immediately above their access opening by a certain circumferential angle while retaining their flat tongue-shaped external plug end; thus, the connecting pins tighten themselves in the plastic bracket while being firmly pressed on the one hand by the transversely aligned spacer portion along the outer side, and on the other hand by the section of the internal terminal twisted transversely along the inner surface of the plastic bracket.

BRIEF DESCRIPTION OF THE DRAWING

While the specification concludes with claims particularly pointing out and distinctly claiming the subject matter which is regarded as the invention, it is believed that the invention will be better understood from the following description of the preferred embodiment taken in conjunction with the accompanying drawings in which:

DESCRIPTION OF A PREFERRED EMBODIMENT

Figure 1:
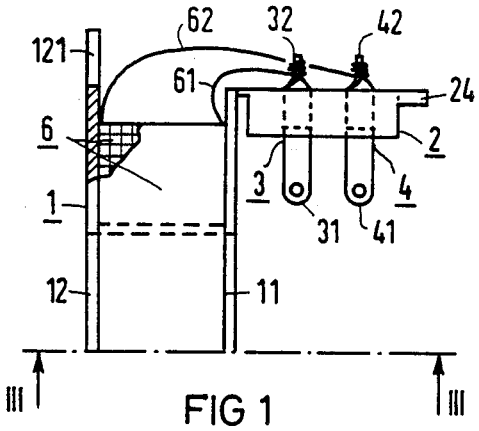
FIG. 1 is a partial section view of a coil form having the hinged plastic bracket pivoted to the side and the winding ends connected.
Figure 2:
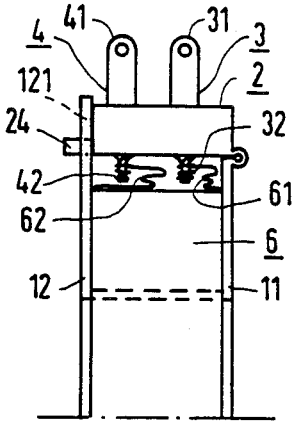
FIG. 2 shows an arrangement in accordance with FIG. 1 with the plastic bracket pivoted and firmly locked into the facing, end flange.
Figure 5:
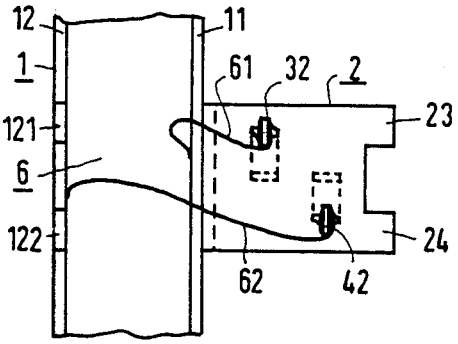
FIG. 5 shows a top view of the pivoted away plastic bracket shown in FIG. 1.

In a partial sectional view, FIG. 1 shows an annular-shaped plastic coil form 1 whose winding space is bounded axially by surrounding end flanges 11 and 12. In the winding space limited axially by end flanges 11 or 12, an exciter winding 6 has been wound. At the radially external edge of the right end flange 11 of coil form 1, a plastic bracket 2 has been integrally injection-molded by means of a hinge-like joint. The plastic bracket 2, as can be seen from FIG. 2, can be pivoted, following the winding connection, to the left by its hinged joint above winding 6 and by means of molded-on locking parts 23, 24 mate with the interlocking segments 121, 122 which are likewise integrally molded onto the left end flange so that the bracket is thus held in place in the operating position.

In order to make contact between the winding ends 61, 62 of exciter coil 6 and the here-not-shown, external leads, two flat tongue-shaped connector pins 3, 4 are inserted in the plastic bracket 2 into access openings which were formed accordingly during molding. The flat tongue-shaped connector pins 3 or 4 each protrude from the radially outer side 21 with an external terminal 31 or 41 and from the radially inner side 22 of plastic bracket 2 with an internal terminal 32 or 42.

Figure 3:
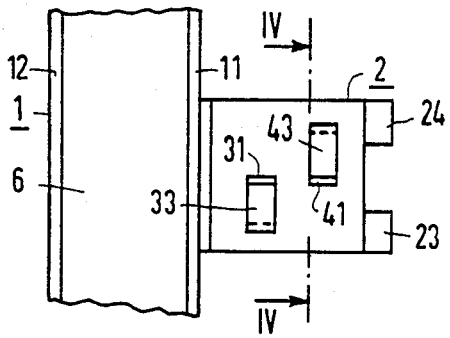
FIG. 3 is a bottom view of the pivoted away plastic bracket shown in FIG. 1.
Figure 4:
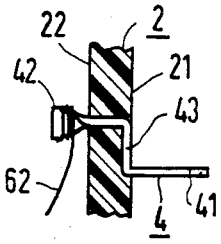
FIG. 4 shows the pivoted away plastic bracket along section IV—IV of FIG. 3.

As can be seen particularly from FIG. 4, to fix the position of the connector pins 3 or 4 inserted in plastic bracket 2, the pins are firmly connected to the outer side 21 of plastic bracket 2 by a transversely aligned spacer portion 33 or 43, which overlaps the access opening between the internal terminal 32 or 42 and the external terminal 31 or 41, and on the other hand firmly connected to the inner side 22 of the plastic bracket 2 by twisting the internal terminals 32 or 42 transversely to the access opening.

FIG. 4 shows the internal terminal 42 after twisting; before twisting it is positioned in a flat pattern at the same level as the section of the internal terminal 42 shown in the access opening of plastic bracket 2 of the flat tongue-shaped connector pin 4 which may be seen from FIG. 4.

FIG. 1 shows the position of plastic bracket 2 in its side, pivoted-away position, in which these internal terminals 32, 42 can be wound with easy access by the lead guide holding the winding wire of coil winding 6 around the winding start or winding end of coil winding 6. By dip-soldering said protruding internal terminals 32 or 42 with the wound winding ends 61, 62, the electrical contact can be further improved; for that purpose coil form 1 is turned around its coil axis to such an extent that the internal terminals 32 or 42 with winding ends 61, 62 are directed downwards and thus can be easily immersed in a soldering bath. For said purpose the internal terminals 32 or 42 are arranged along the inner surface 21 of plastic bracket 2 at the maximum possible mutual spacing to ensure smooth access of the lead guide during automatic winding of the winding ends 61, 62 around the internal terminals 32 or 42. It is thus possible utilizing the coil form design in accordance with this invention to connect in an electrically reliable and mechanically strain relieved fashion the winding ends of the coil wound on the coil form on the one hand and the external connecting line on the other by means of only a few simple assembly procedures in the winding support points of the connector pins held in place by a plastic bracket which can be swivelled from its freely accessible winding position into its operating position.

It will now be understood that there has been disclosed an improved coil form which provides strain relief for the leads connecting to it and a coil form which can be fabricated into an electrical coil, such as a small synchronous motor coil, by automated manufacturing. As will be evident from the foregoing description, certain aspects of the invention are not limited to the particular details of the examples illustrated, and it is therefore contemplated that other modifications or applications will occur to those skilled in the art. It is accordingly intended that the claims shall cover all such modifications and applications as do not depart from the true spirit and script of the invention.

What is claimed as new and desired to be secured by Letters Patent of the United States is:

1. In a coil form having a U-shaped cross section winding space radially open to the outside and bounded axially by end flanges connected to the coil form; an integrally molded plastic bracket hinge-mounted to one of the end flanges which can be pivoted over the winding space; and a plurality of single-component connector pins with external connector pins projecting radially outward from the plastic bracket for connection of external leads and internal terminals projecting radially inward for connecting a plurality of coil winding ends with said plastic bracket being hinged to provide an initial pivoting away from the winding space to facilitate connection of the coil winding ends to the internal terminals and a subsequent pivoting in the opposite direction along with the connected coil ends into a locking engagement with the other end flange while maintaining connection with the coil ends, the improvement comprising said plastic bracket having radially penetrating access openings into which the plurality of single component connector pins are inserted, each of said pins having a respective internal terminal penetrating from the outer surface of the plastic bracket until each pin contacts a transversely aligned spacer portion overhanging each respective radial access opening against the outer side of the plastic bracket, ensuring a strain-relieved positioning; before connecting each said internal terminal projecting from the plastic bracket to one of the coil winding ends, each internal terminal being twisted in an axially concentric fashion through a circumferential angle facing the plastic bracket inserted portion immediately above the access opening while retaining a flat tongue-shaped external plug-in terminal.

2. A coil form according to claim 1, further characterized by having each connector pin be a flat tongue-shaped connector pin.

3. A coil form according to claim 1, further characterized by having a mutual spacing of the internal projecting terminals with maximum possible mutual spacing along the inner surface of the plastic bracket.

4. A coil form according to claim 2, further characterized by having a mutual spacing of the internal projecting terminals with maximum possible mutual spacing along the inner surface of the plastic bracket.

5. A coil form according to claim 1, further characterized by having the overhanging internal unwound terminals bent away from each other to increase the mutual spacing.

6. A coil form according to claim 2, further characterized by having the overhanging internal unwound terminals bent away from each other to increase the mutual spacing.

7. A coil form according to claim 3, further characterized by having the overhanging internal unwound terminals bent away from each other to increase the mutual spacing.

* * * * *